US012196056B2

(12) United States Patent
Almusallam

(10) Patent No.: US 12,196,056 B2
(45) Date of Patent: Jan. 14, 2025

(54) ANTI-SPINNING COMPRESSIBLE DEVICE

(71) Applicant: SAUDI ARABIAN OIL COMPANY, Dhahran (SA)

(72) Inventor: Ali A. Almusallam, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 56 days.

(21) Appl. No.: 18/060,643

(22) Filed: Dec. 1, 2022

(65) Prior Publication Data

US 2024/0183245 A1 Jun. 6, 2024

(51) Int. Cl.
*E21B 33/129* (2006.01)
*E21B 29/00* (2006.01)

(52) U.S. Cl.
CPC ..... *E21B 33/1293* (2013.01); *E21B 29/00* (2013.01)

(58) Field of Classification Search
CPC .. E21B 33/134; E21B 33/1204; E21B 33/129; E21B 33/128
See application file for complete search history.

(56) References Cited

U.S. PATENT DOCUMENTS 1,670,964 A * 5/1928 Hay et al.
1,821,426 A * 9/1931 Howard et al.
3,684,010 A * 8/1972 Young
2018/0179851 A1* 6/2018 Davies et al.

FOREIGN PATENT DOCUMENTS

EP 3347564 B1 7/2018

* cited by examiner

*Primary Examiner* — Tara Schimpf
*Assistant Examiner* — Ursula Lee Norris
(74) *Attorney, Agent, or Firm* — Vorys, Sater, Seymour and Pease LLP

(57) ABSTRACT

A downhole tool includes a bridge plug and an anti-spin device operatively coupled to the bridge plug and including an elongate housing coupled to a downhole end of the bridge plug and defining an internal cavity, one or more slips radially aligned with a corresponding one or more slots defined in the elongate housing, a mandrel movably arranged within the internal cavity and terminating with a head, and a slip activator moveably arranged within the internal cavity and being engageable with the one or more slips when translating within the internal cavity. Placing an axial load on the bridge plug causes the anti-spin device to transition from a non-compressed state, where the slip activator is disengaged from the one or more slips, to a compressed state, where the slip activator engages and urges the one or more slips radially outward and through the corresponding one or more slots.

16 Claims, 7 Drawing Sheets

ANTI-SPINNING COMPRESSIBLE DEVICE

FIELD OF THE DISCLOSURE

The present disclosure relates generally to well equipment accessories and, more particularly, to an anti-spin device that can be compressed to project one or more slips into the interior sidewall of a wellbore to inhibit the device, and/or equipment attached to the device, from spinning during a subsequent milling operation.

BACKGROUND OF THE DISCLOSURE

In the oil and gas industry, wells are drilled to access subsurface hydrocarbon reservoirs. To complete the wells, one or more mechanical work-over operations and/or perforation operations can be implemented to achieve a desired fluid communication between the wellbore and the subsurface reservoir. Prior to such operations, existing pre-formations can be temporarily isolated in order to isolate the reservoir and prevent formation damage. For such applications, bridge plugs are commonly used and set at targeted positions within the wellbore. However, a single bridge plug might not suffice as it may fail upon pressure testing, whereupon a second bridge plug can be set.

Once the desired operation is completed, the bridge plugs positioned within the wellbore are typically milled to restore well accessibility and resume the well's production. Upon attempting to mill through a set bridge plug, however, the bridge plug can occasionally dislodge and start to rotate or spin within the wellbore. Regardless of how much weight is applied to the bridge plug from the well surface, the plug will either continue to rotate or be pushed further downhole within the wellbore until reaching a solid end. This may require several trips into the wellbore, which can incur very high cost.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

In accordance with various embodiment, a downhole tool is provided. The downhole tool can comprise a bridge plug. Also, the downhole tool can comprise an anti-spin device operatively coupled to the bridge plug. The anti-spin device can include an elongate housing coupled to a downhole end of the bridge plug and defining an internal cavity. Further, the anti-spin device can include one or more slips radially aligned with a corresponding one or more slots defined in the elongate housing. Also, the anti-spin device can include a mandrel movably arranged within the internal cavity and terminating with a head. Moreover, the anti-spin device can include a slip activator arranged within the internal cavity and engageable with the one or more slips when translating within the internal cavity. Placing an axial load on the bridge plug causes the anti-spin device to transition from a non-compressed state, where the slip activator is disengaged from the one or more slips, to a compressed state, where the slip activator engages and urges the one or more slips radially outward and through the corresponding one or more slots.

In accordance with another embodiment, a method is provided. The method can comprise advancing a mill into a wellbore and toward a bridge plug arranged within the wellbore. The method can also comprise placing an axial load on the bridge plug with the mill and thereby actuating an anti-spin device operatively coupled to the bridge plug. The anti-spin device can include an elongate housing coupled to a downhole end of the bridge plug and defining an internal cavity. The anti-spin device can also include one or more slips radially aligned with a corresponding one or more slots defined in the elongate housing. Further, the anti-spin device can include a mandrel movably arranged within the internal cavity and terminating with a head. Moreover, the anti-spin device can include a slip activator movably arranged within the internal cavity and engagable with the one or more slips. Additionally, the method can comprise compressing the anti-spin device with the axial load between a non-compressed state, where the slip activator is disengaged from the one or more slips, and a compressed state, where the slip activator engages and urges the one or more slips radially outward and through the corresponding one or more slots. Also, the method can comprise securing the anti-spin device within the wellbore and thereby preventing the bridge plug from rotating during milling of the bridge plug.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1A:
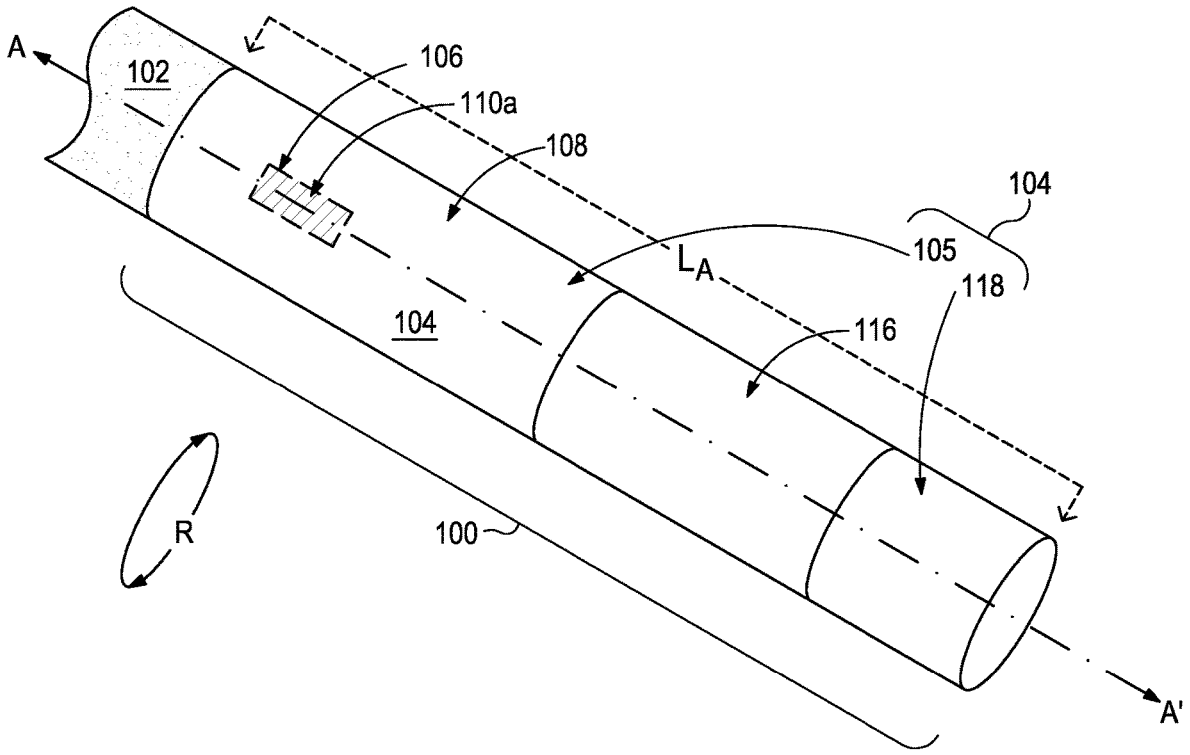
FIG. 1A illustrates a diagram of a non-limiting example anti-spin device in a non-compressed state in accordance with one or more embodiments described herein.

Embodiments of the present disclosure will now be described in detail with reference to the accompanying figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As described above, milling operations are typically performed to remove bridge plugs positioned (deployed) within a wellbore. High pressure coil tubing ("HPCT") is typically used to convey a mill downhole to locate and mill through these bridge plugs. However, the milling operation can be frustrated if the bridge plug detaches from the walls of the wellbore and starts to rotate and/or spin within the wellbore (e.g., where there is an insufficient amount of contact and/or friction between the subject bridge plug and the interior of the wellbore). Additionally, any additional weight applied to the spinning bridge plug during the milling operation can force the bridge plug further downhole until a solid end is reached. Eventually, several HPCT trips might be undertaken, which could incur a very high undesirable cost.

Dissolvable bridge plugs can be utilized, thereby negating the necessity of the milling operation to remove the plugs. However, the solubility of the bridge plugs can be a hindrance to the development of the well. For instance, the operations enabled by the plug must be completed by the time plug has degraded. Failure to complete operations before degradation of a dissolvable bridge plug can result in damage to the well, the subsurface reservoir, and/or the reservoir quality (e.g., via pumped loss circulation materials or "LCM").

Embodiments in accordance with the present disclosure generally relate to anti-spin devices that can be included with or coupled to well equipment (e.g., bridge plugs) that are to be subsequently milled from the wellbore. The anti-spin devices can prevent the well equipment from rotating and/or spinning during the milling operation. The anti-spin devices can comprise one or more slips and helical compression springs, where compression of the one or more springs can result in the one or more slips protruding from a surface of the anti-spin device to grip the inner wall of a surrounding wellbore or casing.

As used herein, the term "slips" can be synonymous with "slip devices" and can refer to self-gripping (e.g., toothed devices) for establishing non-slip contact with an adjacent surface, such as a wellbore wall. In accordance with various embodiments described herein, slips can grip the adjacent surface and establish enough friction at the slips-to-surface interface to inhibit translation of the slips across the surfaces. For example, the slips can include textured contact pads forced against the adjacent surface to inhibit movement. In various embodiments, the slips can be made of a millable material and milled during one or more milling operations. In some embodiments, the slips described herein can be retrieved from the wellbore with magnets or a reverse circulation junk basket upon completion of a milling operation within the well.

During the milling operation, an applied weight on the well equipment, and thereby the anti-spin device, will help compress the spring(s), thereby forcing the slips to emerge (extend out) from the sides of the anti-spin device. The slips can be configured to engage the interior walls of the wellbore (or a casing, liner, etc.) and establish friction between the wellbore and the well equipment via the fixed anti-spin device. By engaging the walls of the wellbore (or a casing, liner, etc.), the anti-spin device can prevent the well equipment from rotating and/or spinning during the milling operation. As soon as the milling bottom hole assembly (BHA) is picked up, the weight on the well equipment will be eased, thereby decompressing the spring(s) and retracting the slips. Additionally, in one or more embodiments the anti-spin device can be composed of materials that can also be milled during the milling operation.

In one or more embodiments, the anti-spin device can comprise one or more slips positioned radially about a longitudinal axis. For example, the anti-spin device can have a substantially cylindrical housing, where the slips are spaced along a sidewall of the housing. In one or more embodiments, the one or more slips can be aligned with one or more slots (opening) in the housing of the anti-spin devices, such that each slip can extend through a respective slot upon compression of the anti-spin device. In various embodiments, the slips can be composed of one or more materials rigid including, but not limited to, a metal, a ceramic, a composite material, a non-metallic material, or any combination thereof. In some embodiments, the outer surfaces of some or all of the slips may be smooth. In other embodiments, however, some, or all, of the outer surface of the slips may provide a toothed or jagged profile capable of biting into the inner wall of the wellbore, the inner wall of a casing or liner arranged within the wellbore and in which the bridge plug is deployed, or the interior surface of production tubing. In yet other embodiments, a gripping material, such as a grit or hardened proppant, may be applied to the outside surfaces of the slips with an epoxy or another suitable binder. The gripping material may be useful in helping to grip the inner wall of the wellbore, or the inner wall of a casing or liner arranged within the wellbore and in which the bridge plug is deployed.

The number of slips included in the anti-slip device can be at least one, but could include more, depending on the application and need. The number of slips, and their spacing/ positioning about the circumference of the anti-spin devices, can vary based on the size, dimensions, and/or function of the anti-spin devices and/or the well equipment fixed to the anti-spin devices. In some embodiments, the anti-slip device can comprise, for example, about 1 to 12 slips. In various embodiments, the slips can be single acting or double acting devices.

Additionally, the anti-spin devices described herein can comprise one or more springs including, but not limited to: helical compression springs, convex springs, concave springs, conical springs, straight coil springs, variable pitch springs, and/or volute springs. In various embodiments, the anti-spin devices can be in a non-compressed state while the one or more springs are not compressed and in a compressed state while the one or more springs are compressed. In one or more embodiments, the springs can be surrounded by a flexible sleeve that covers the springs and prevents debris from entering the anti-spin device and/or inhibiting the function of the springs.

While the anti-spin device is in the non-compressed state, the slips can be substantially seated within the housing. For example, while the anti-spin device is in the non-compressed state, an exterior surface of the slips (e.g., a contact surface) can be substantially flush with, or recessed within, an exterior surface of the housing of the anti-spin device. In another example, while the anti-spin device is in the non-compressed state, the exterior surface of the slips can be positioned closer to the longitudinal axis of the anti-spin device than the exterior surface of the housing. As the anti-spin device is compressed axially and transitioned to the compressed state, the slips can be forced radially outward to protrude past the exterior surface of the housing.

Thus, while the anti-spin device is in the compressed state, the slips can project from the exterior surface of the housing. For example, when the anti-spin device is in the compressed state, the exterior surface of the plurality of slips can be positioned further from the longitudinal axis of the anti-spin device than the exterior surface of the housing. For instance, compressing the anti-spin device can force the plurality of slips away from the exterior surface of the housing and towards the walls of the wellbore (or a casing or liner arranged in the wellbore), such that the slips can contact the sidewalls of the wellbore while the anti-spin device is in the compressed state.

Figure 1B:
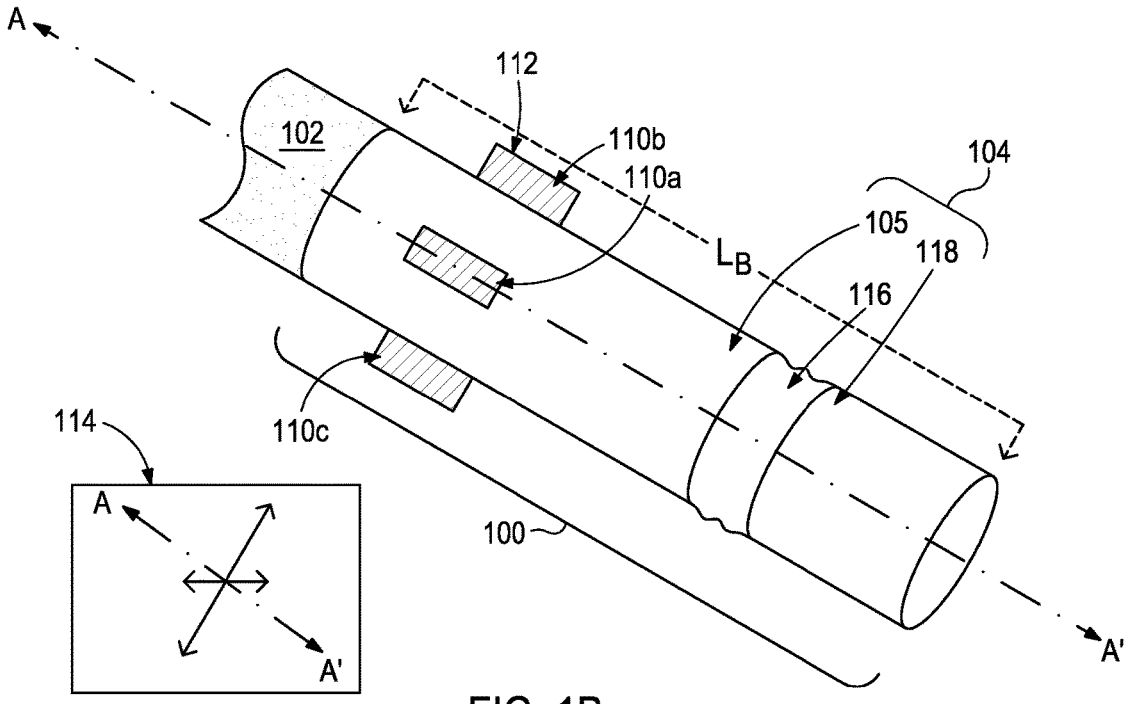
FIG. 1B illustrates a diagram of the non-limiting example anti-spin device in a compressed state in accordance with one or more embodiments described herein.

FIGS. 1A and 1B illustrate a non-limiting example anti-spin device 100 in accordance with one or more embodiments described herein. As shown in FIGS. 1A and 1B, the anti-spin device 100 can be fixed to well equipment 102, such as a bridge plug. In at least one embodiment, the anti-spin device 100 can be an auxiliary device that is attachable to, and/or removable from, the well equipment 102. In other embodiments, however, the anti-spin device 100 can form an integral part or extension of the well equipment 102, without departing from the scope of the disclosure. The anti-spin device 100 and the well equipment 102 are cooperatively referred to herein as a "downhole tool." FIG. 1A depicts the anti-spin device 100 in a non-compressed state, and FIG. 1B depicts the anti-spin device 100 in a compressed state.

The anti-spin device 100 can have a substantially cylindrical shape, which helps facilitate entry into a wellbore. The diameter of the anti-spin device 100 can vary depending on the dimensions of the wellbore and/or the dimensions of the well equipment 102. While in the non-compressed state, the anti-spin device 100 can have a first length "$L_A$". While in the compressed state, the anti-spin device 100 can have a second length "$L_B$". The first length $L_A$ is greater than the second length $L_B$. The length of the anti-spin device 100 can vary depending, for example, on the dimensions of the well equipment 102 or to fit a particular application.

In various embodiments, the well equipment 102 can be fixed to a first or "uphole" end of the anti-spin device 100. For example, the anti-spin device 100 can include a housing 104 and the well equipment 102 can be fixed to the housing 104. Additionally, the housing 104 can include a body 105. The well equipment 102 can be fixed by a variety of means, including, but not limited to, welding, mechanical fasteners (e.g., bolts and/or screws), a threaded connection, an adhesive, an interference fit, or any combination thereof. In at least one embodiment, the anti-spin device 100 can form an integral part and extension of the well equipment 102, as mentioned above.

The housing 104 can be composed of a variety of materials including, but not limited to metals, ceramics, non-metals, compositional alloys, or any combination thereof. Also, the housing 104 may define one or more slots 106 in an exterior surface 108 of the anti-spin device 100. In FIG. 1A, a visible slot 106 is delineated with bold dashed lines for clarity. The slots 106 can be defined about the outer circumference of the housing 104 and oriented in a common plane, e.g., along a direction delineated by the "R" arrow, and about a longitudinal axis A-A' of the anti-spin device 100. In one or more embodiments, the slots 106 can be positioned within the body 105 of the housing 104.

The anti-spin device 100 may further include a plurality of slips 110, and each slip 110 may be configured to align with a corresponding slot 106. In the illustrated example, three slots 106 are visible, and a corresponding three slips 110 are aligned with the slots 106. It will be appreciated, however, that embodiments including more or fewer slips 110 are also contemplated herein. In various embodiments, the slips can be positioned within the body 105 of the housing 104.

When the anti-spin device 100 is in the non-compressed state, the slips 110 are positioned substantially within (e.g., retracted within) the housing 104. Thus, only the first slip 110*a* is visible in FIG. 1A (e.g., through the corresponding slot 106 in the exterior surface 108 of the housing 104). When the anti-spin device 100 is transitioned to the compressed state, the slips 110 are urged to extend radially outward and past the exterior surface 108 of the housing 104 and away from the longitudinal axis A-A' of the anti-spin device 100.

In FIG. 1B, three slips 110*a*, 110*b*, and 110*c* are visible, each of which extend from respective slots 106 in the exterior surface 108. In some embodiments, as illustrated, one or more of the slips 110 may exhibit a generally rectangular geometry. In other embodiments, however, one or more of the slips 110 may exhibit an alternate geometry, without departing from the scope of the disclosure. For example, the slips 110 can exhibit a circular geometry or another type of polygonal geometry (e.g., square, pentagonal, hexagonal, trapezoidal, wedge, etc.). Additionally, while the slips 110 are depicted in FIG. 1B as being arranged along a specific portion of the length of the housing 104, it is contemplated herein to have an embodiment in which one or more of the slips 110 extend along an entire, or substantially entire, length of the housing 104. Further, while the slips 110 and the corresponding slots 106 are shown axially aligned and otherwise arranged in a common plane on the housing 104, in one or more embodiments, the slips 110 and the corresponding slots 106 can be positioned in one or more pattern and/or grid formations along the exterior surface 108.

The slips 110 can have a contact surface 112 that is positioned flush with (or within) the exterior surface 108 of the housing 104 when the anti-spin device 100 is in the non-compressed state (e.g., as shown in FIG. 1A). When the anti-spin device 100 transitions to the compressed state, the slips 110 are urged radially outward from the exterior surface 108, which move the respective contact surfaces 112 further from the longitudinal axis A-A' than the exterior surface 108 (e.g., as shown in FIG. 1B). For example, the legend 114 shown in FIG. 1B illustrates some example trajectories that the slips 110 may extend along as the anti-spin device 100 transitions between the non-compressed and compressed states.

In one or more embodiments, the slips 110 can have a uniform, or substantially uniform, material composition. For example, the slips 110 can have a single layer architecture. Alternatively, in some embodiments the slips 110 can have a multilayer architecture with one or more layers having a different material composition than one or more other layers. For example, the contact surface 112 can be composed of a first layer having a different material composition than one or more other layers defining the body of the slip 110 (e.g., the contact surface 112 can comprise one or more embedded hard particles, such as embedded polycrystalline diamond or a carbide, to facilitate gripping the sidewalls of the wellbore). Additionally, in one or more embodiments, the contact surface 112 can be textured to facilitate interaction with the sidewalls of the wellbore or a casing string or tubing in which the well equipment 102 is deployed. In accordance with various embodiments described herein, the contact surface 112 can have an abrasive texture to facilitate gripping the sidewall of the wellbore.

In one or more embodiments, the anti-spin device 100 can further comprise a sleeve 116 extending from the body 105 of the housing 104 to a head 118 of the housing 104 of the anti-spin device 100. The sleeve 116 may be configured to cover one or more springs (not shown in FIGS. 1A-1B), which can also extend from the housing 104 to the head 118. As the one or more springs are compressed, the length of the anti-spin device 100 transitions from the first length $L_A$ to the second length $L_B$. Also, as the one or more springs are compressed, the sleeve 116 is able to fold and/or collapse between the body 105 and the head 118 of the housing 104. The sleeve 116 can be composed of one or more flexible materials, including, but not limited to, a polymer, a malleable metal, a composite material, a non-metallic material, a fabric, an elastomer, or any combination thereof. In various embodiments, the one or more slots 106 and/or slips 110 can be positioned within the head 118 of the housing 104.

Figure 2B:
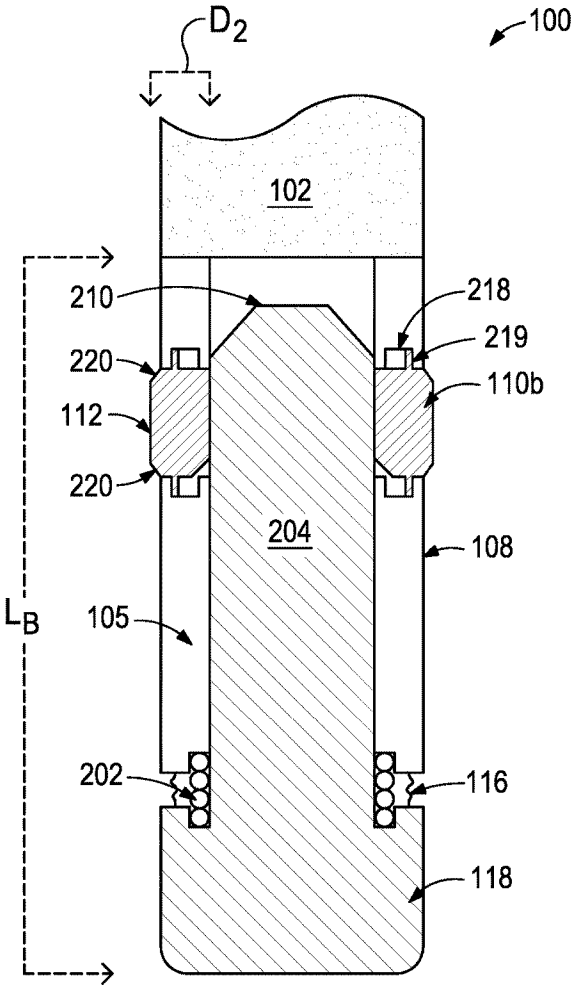
FIG. 2B illustrates a cross-sectional view of the first non-limiting example internal mechanism that can be embodied by the anti-spin device while in a compressed state in accordance with one or more embodiments described herein.
Figure 2A:
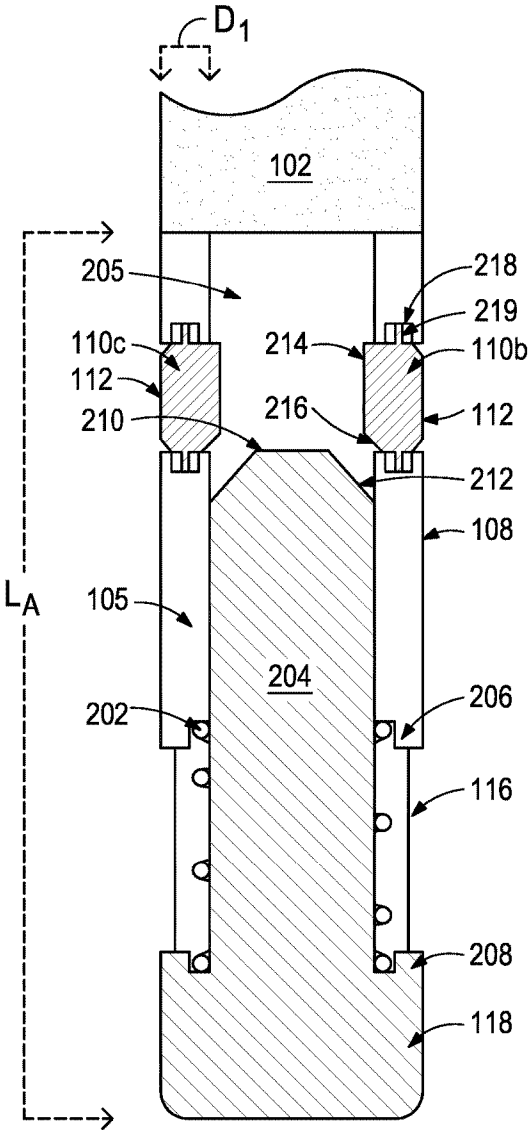
FIG. 2A illustrates a cross-sectional view of a first non-limiting example internal mechanism that can be embodied by the anti-spin device while in a non-compressed state in accordance with one or more embodiments described herein.

FIGS. 2A and 2B illustrate non-limiting examples of an internal mechanism that can be employed by the anti-spin device 100 to translate compression of a spring 202 to projection of the slips 110, in accordance with one or more embodiments described herein. The internal mechanism shown in FIGS. 2A and 2B includes a mandrel 204 configured to forcefully displace the slips 110 radially outward when the anti-spin device 100 transitioned from the non-compressed state to the compressed state. FIG. 2A depicts a cross-sectional view of the anti-spin device 100 while in the non-compressed state, and FIG. 2B depicts a cross-sectional view of the anti-spin device 100 while in the compressed state. The internal mechanisms depicted in FIGS. 2A and 2B are exemplary, and embodiments of the anti-spin device 100 comprising an alternate internal architecture connecting the spring 202 to the slips 110 are also contemplated herein.

As shown in FIGS. 2A and 2B, the head 118 may be coupled to or otherwise form an integral part (extension) of the mandrel 204, which extends into the body 105 of the housing 104 (FIGS. 1A-1B). More particularly, the housing 104 defines an internal cavity 205, and the mandrel 204 may be sized to be received within the cavity 205. Additionally, the spring 202 can surround at least a portion of the mandrel 204. For example, a first end of the spring 202 can be seated and/or fixed within a first flange 206 of the housing 104, and a second end of the spring 202 can be seated and/or fixed within a second flange 208 of the mandrel 204 (e.g., the head 118). In one or more embodiments, the head 118 of the housing 104 and/or mandrel 204 can be composed of the same material as the housing 104. Alternatively, the head 118 and/or the mandrel 204 can be composed of a different material than the housing 104. Example materials suitable for the head 118 and/or the mandrel 204 include, but are not limited to, a metal, a non-metallic material, a polymer, a composite material, or any combination thereof.

FIGS. 2A and 2B exemplify how the compression state of the spring 202 can define the position of the mandrel 204 and/or the distance at which the contact surface 112 of the slips 110 extend from the exterior surface 108 of the housing 104 (e.g., from an exterior surface 108 of the body 105 and/or the head 118 of the housing 104). While in the compressed state, a larger portion of the mandrel 204 resides in the cavity 205 of the housing 104 (e.g., as shown in FIG. 2B), as compared to when the anti-spin device 100 is in the non-compressed state (e.g., as shown in FIG. 2A). The spring 202 may be configured to naturally bias the head 118 away from the housing 104. In the non-compressed state, the spring 202 can be largely uncompressed, and the head 118 can be at its furthest position from the housing 104, thereby less of the mandrel 204 is positioned within the cavity 205. In the compressed state, the head 118 is forced towards the housing 104, thereby compressing the spring 202 and advancing a larger portion of the mandrel 204 into the cavity 205.

In various embodiments, a first or "uphole" end 210 of the mandrel 204 can have a tapered or angled structure to facilitate interaction with the slips 110. For example, the uphole end 210 can provide or otherwise define one or more tapered side surfaces 212 configured to align with the slips 110. Additionally, an interior surface 214 of the slips 110 can have an interior slanted side surface 216 configured to slidingly engage the tapered side surfaces 212 of the mandrel 204. In various embodiments, the uphole end 210 of the mandrel 204 can serve as a slip activator to engage the slips 110 and/or push the slips 110 radially outward from the exterior surface 108 of the housing 104.

As shown in FIGS. 2A and 2B, the slips 110 can be completely housed within the cavity 205 when the anti-spin device 100 is in the non-compressed state. As the anti-spin device 100 is compressed and transitions to the compressed state, the mandrel 204 is urged further into the cavity 205 and towards the slips 110. Eventually, the tapered side surfaces 212 of the mandrel 204 are forced into sliding contact with the interior slanted side surfaces 216 of the slips 110, which forces the slips 110 radially outward and out of the housing 104. FIG. 2B depicts the mandrel 204 engaging and forcing the slips 110 radially outward to extend past the exterior surface 108 of the housing 104. Additionally, while in the compressed state, the mandrel 204 prevents the slips 110 from retracting radially back into the cavity 205.

Thus, when the anti-spin device 100 is under axial compression, the slips 110 are correspondingly forced to extend radially outward and otherwise away from the internal cavity 205 to project from the exterior surface 108 of the housing 104. While the spring 202 is in the non-compressed state, the contact surface 112 of the slips 110 can be positioned a first distance "$D_1$" from the internal cavity 205 (e.g., as shown in FIG. 2A). While the spring 202 is in the compressed state, the contact surface 112 of the slips 110 can be positioned a second distance "$D_2$" from the internal cavity 205 (e.g., as shown in FIG. 2B). The second distance $D_2$ is greater than the first distance $D_1$ such that the contact surface 112 is moved further from the longitudinal axis A-A' as the anti-spin device 100 is moved to the compressed state.

In one or more embodiments, the slots 106 in the housing 104 can be defined by one or more sidewalls having one or more grooves 218 (e.g., recesses extending into the sidewalls). Further, the sides of one or more of the slips 110 can have one or more protrusions 219 that extend into the grooves 218 (e.g., FIGS. 2A and 2B each depict four exemplary grooves 218 and associate protrusions 219). The protrusions 219 can extend from one or more side surfaces (or ends) of the slips 110 that face the sidewalls of the slots 106, thereby movably coupling the slips 110 to the housing 104. The grooves 218 may be configured to help prevent the slips 110 from dislodging from the anti-spin device 100. As shown in FIGS. 2A and 2B, the protrusions 219 can travel laterally within the one or more grooves 218 as the slips 110 are displaced radially outward and inward.

Additionally, the contact surface 112 of the slips 110 can having one or more exterior slanted surfaces 220. While the anti-spin device 100 is in the non-compressed state, the one or more exterior slanted surfaces 220 can facilitate engaging the walls of the wellbore to push the slips 110 into the housing 104 and enable travel of the anti-spin device 100.

Figure 3B:
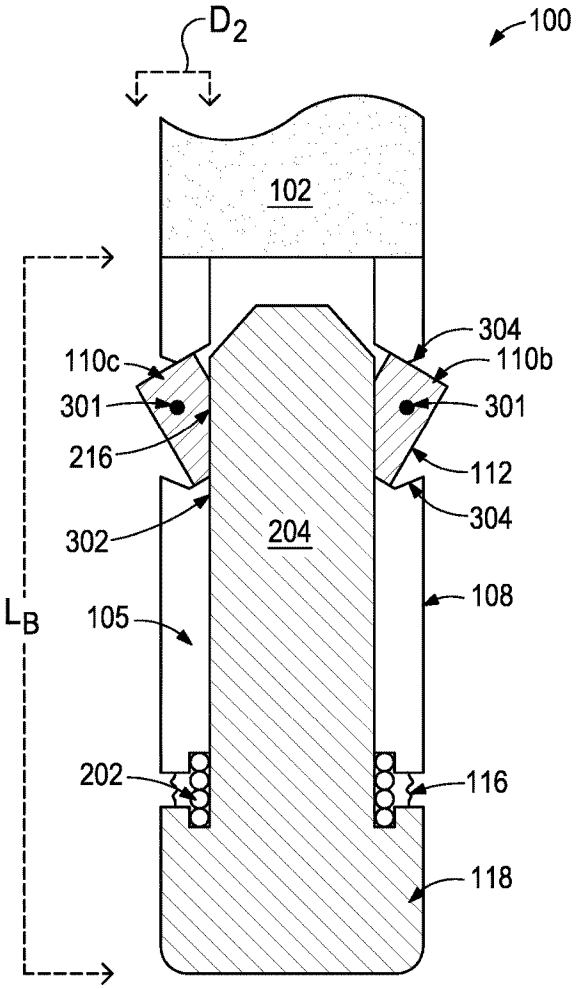
FIG. 3B illustrates a cross-sectional view of the second non-limiting example internal mechanism that can be embodied by the anti-spin device while in the compressed state in accordance with one or more embodiments described herein.
Figure 3A:
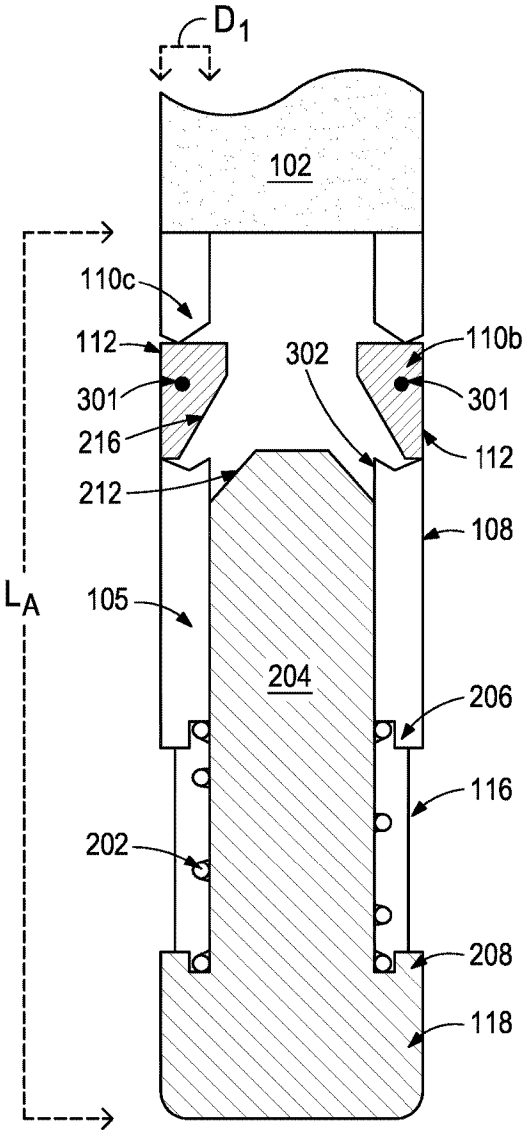
FIG. 3A illustrates a cross-sectional view of a second non-limiting example internal mechanism that can be embodied by the anti-spin device while in the non-compressed state in accordance with one or more embodiments described herein.

FIGS. 3A and 3B illustrate non-limiting examples of an alternative embodiment of the internal mechanism that can be employed by the anti-spin device 100 to translate compression of the spring 202 to projection of the slips 110 in accordance with one or more embodiments described herein. The example internal mechanism shown in FIGS. 3A and 3B utilizes the mandrel 204 to forcefully rotate the slips between retracted and extended states as the anti-spin device 100 transitions between the non-compressed and compressed states. FIG. 3A depicts a cross-sectional view of the anti-spin device 100 while in the non-compressed state, and FIG. 3B depicts a cross-sectional view of the anti-spin device 100 while in the compressed state.

In FIGS. 3A and 3B, the slips 110 can be positioned within the slots 106 and coupled to the housing 104 (FIGS. 1A-1B) at a centrally located rotatable mounting bracket 301 of the slip 110. Consequently, the slips 110 may be configured to rotate about the rotatable mounting bracket 301 as the tapered side surfaces 212 of the mandrel 204 meet (engage) the interior slanted side surface 216 of the slips 110 as the spring 202 compresses. The centrally located rotatable mounting bracket 301 for slips 110*b* and 110*c* are delineated by black circles in FIGS. 3A and 3B for clarity. In various embodiments, the rotatable mounting bracket 301 can be a protrusion (e.g., a rod) extending from the side surface of the slip 110 and into a socket within a sidewall of the corresponding slot 106.

As shown in FIG. 3A, when the anti-spin device 100 is in the non-compressed state, the contact surface 112 of the slips 110 can be flush (e.g., substantially parallel) with the exterior surface 108 of the housing 104. Additionally, the interior slanted surfaces 216 of the slips 110 can extend past an interior surface 302 of the housing 104 and into the interior cavity 205 defined by the housing 104. As shown in FIG. 3B, when the anti-spin device 100 transitions to the compressed state, the mandrel 204 may engage and rotate the slips 110 such that the interior slanted surfaces 216 become flush (e.g., substantially parallel) with the interior surface 302 of the housing 104. As the slips 110 rotate, the contact surface 112 of the slips 110 can be forced to extend past the exterior surface 108 of the housing 104.

More specifically, as the anti-spin device 100 is compressed, the mandrel 204 can travel through the cavity 205 and force the slips 110 to rotate within the slots 106. As a result of the rotation, the contact surface 112 of the slips 110 can be projected out from the exterior surface 108 of the housing 104 and towards the sidewalls of the wellbore (e.g., where the anti-spin device 100 is positioned within the wellbore). Further, the force exerted on the sidewalls of the wellbore by the forced rotation of the slips 110 can inhibit spinning (rotation) of the anti-spin device 100 within the wellbore. As shown in FIGS. 3A and 3B, the slots 106 can have slanted side surfaces 304 to provide clearance for the slips 110 during rotation. In one or more embodiments, the slanted side surfaces 304 can be sloped such that interior cavity 205 of the anti-spin device 100 remains isolated from the exterior environment surrounding the housing 104. For example, the slanted side surfaces 304 can be sloped such that the slips 110 close (e.g., plug) the associate slot 106 in both the non-compressed and compressed states.

Figure 4B:
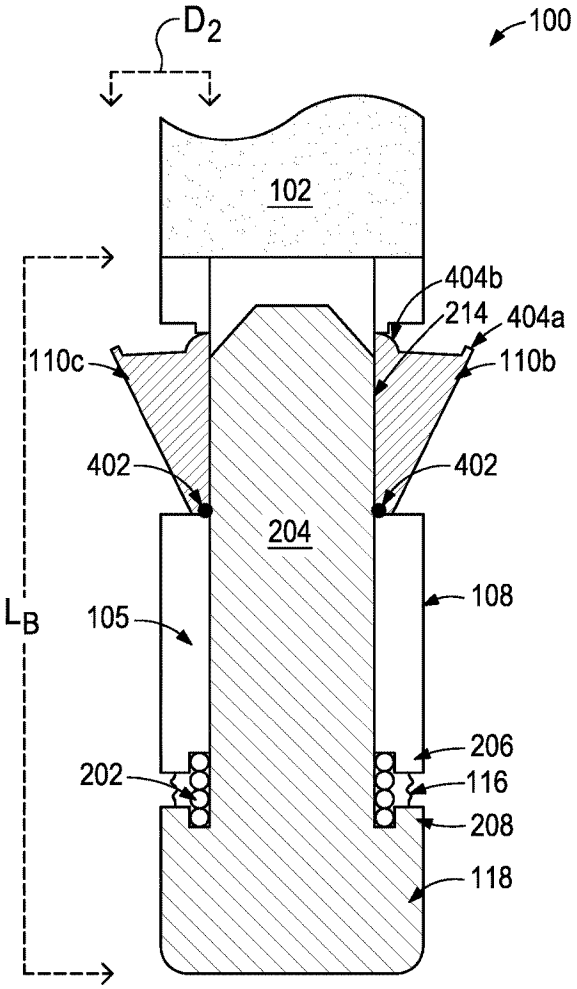
FIG. 4B illustrates a cross-sectional view of the third non-limiting example internal mechanism that can be embodied by the anti-spin device while in the compressed state in accordance with one or more embodiments described herein.
Figure 4A:
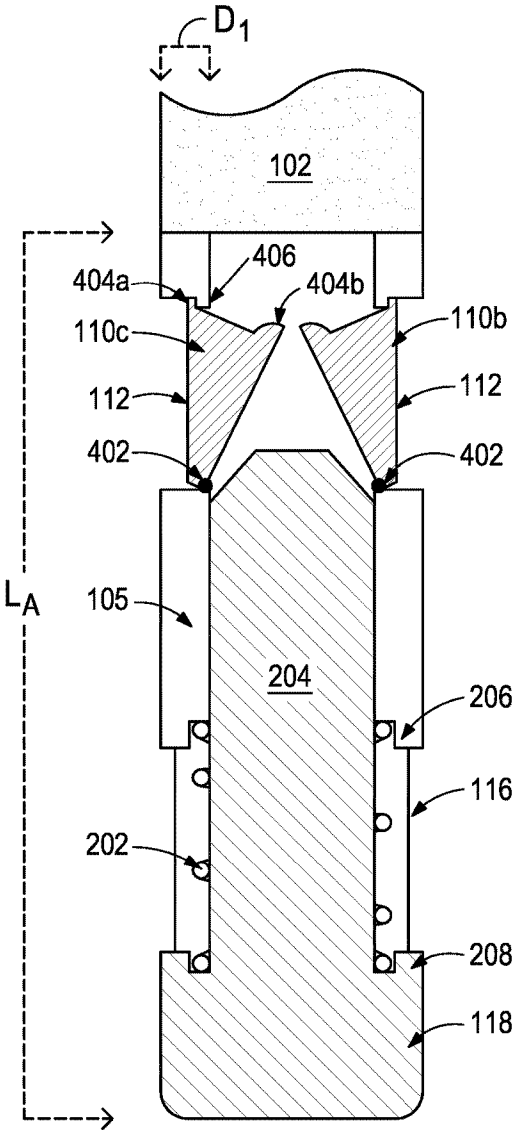
FIG. 4A illustrates a cross-sectional view of a third non-limiting example internal mechanism that can be embodied by the anti-spin device while in the non-compressed state in accordance with one or more embodiments described herein.

FIGS. 4A and 4B illustrate non-limiting examples of another alternative embodiment of the internal mechanism that can be employed by the anti-spin device 100 to translate compression of the spring 202 to projection of the slips 110, in accordance with one or more embodiments described herein. The example internal mechanism shown in FIGS. 4A and 4B utilizes the mandrel 204 to forcefully rotate the slips 110 about a hinge 402 between the non-compressed and compressed states. FIG. 4A depicts a cross-sectional view of the anti-spin device 100 while in the non-compressed state, and FIG. 4B depicts a cross-sectional view of the anti-spin device 100 while in the compressed state. In the example internal mechanism depicted in FIGS. 4A and 4B, the slips 110 can be coupled to the housing 104 (FIGS. 1A-1B) via respective hinges 402.

In the illustrated embodiment, the slips 110 can have a substantially wedge shape to facilitate interaction with the mandrel 204, where a first end of the slips 110 can be coupled to the housing 104 via a hinge 402 and a second end of the slips 110 can include one or more projections 404. For example, a first projection 404*a* can abut a third flange 406 extending from a sidewall of the slots 106 while the anti-spin device 100 is in the non-compressed state. For instance, the third flange 406 can inhibit the slips 110 from over rotating about the hinge 402 into the cavity 205 (e.g., as shown in FIG. 4A).

When the anti-spin device 100 is in the non-compressed state, the slips 110 can have the interior surface 214 (e.g., also serving as a slanted surface 216) and second projection 404*b* positioned within the cavity 205. As the anti-spin device 100 is compressed, the mandrel 204 can force the slips 110 to rotate about the respective hinges 402 such that the interior surfaces 214 are displaced from the cavity 205. While the spring 202 is compressed, the first end of the slips 110 can abut a sidewall of the slots 106 to which the hinges 402 are coupled (e.g., as shown in FIG. 4B). Also, while the spring 202 is compressed, the second projections 404*b* can abut and otherwise engage the third flange 406, which helps maintain the slot 106 in a closed state (e.g., thereby inhibiting debris from readily entering the cavity 205). Further, FIG. 4A exemplifies that the contact surface 112 of the slips 110 can be recessed below the exterior surface 108 of the housing 104 while the spring 202 is in the non-compressed state (e.g., as opposed to the flush configuration exemplified in FIGS. 2A and 3A).

Additionally, in one or more embodiments, an internal mechanism can be employed in which the mandrel 204 is utilized to forcefully deform the slips 110 between the non-compressed state and the compressed state. For example, one or more ends of the slips 110 can be fixed to the housing 104 within the slot 106. As the mandrel 204 contacts the interior slanted side surface 216 (FIG. 3A), an unfixed end of the slip 110 can be forced away from the housing 104, thus bending the contact surface 112 of the slip 110 away from the exterior surface 108 of the housing 104. For instance, the uphole end 210 of the mandrel 204 can act as a wedge that pushes a portion of the slips 110 away from the housing 104, thereby deforming the shape of the slips 110 and forcing the contact surface 112 of the slips 110 to project outwardly (e.g., with reference to the longitudinal axis A-A' of the anti-spin device 100) from the exterior surface 108 of the housing 104.

Figure 5:
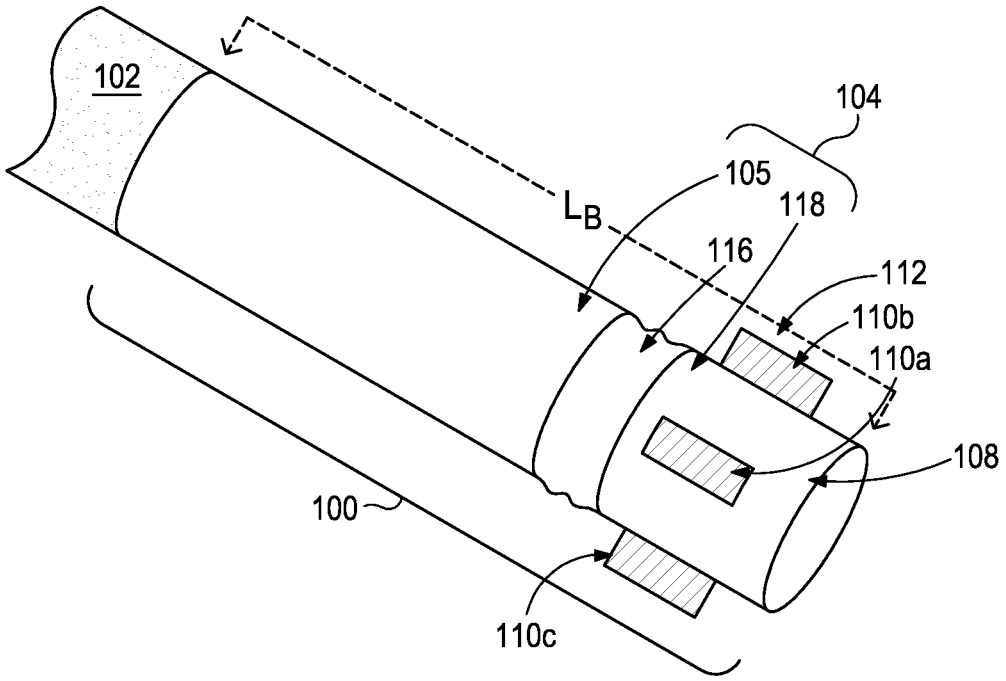
FIG. 5 illustrates another diagram of the non-limiting example anti-spin device in a compressed state in accordance with one or more embodiments described herein.

FIG. 5 depicts another example embodiment of the non-limiting anti-spin device 100, where the slips 110 can be positioned within the head 118 of the housing 104 in accordance with one or more embodiments described herein. For example, FIG. 5 depicts the example anti-spin device 100 in the compressed state, where the slips 110 extend from the exterior surface 108 of the head 118 portion of the housing 104.

Figure 6B:
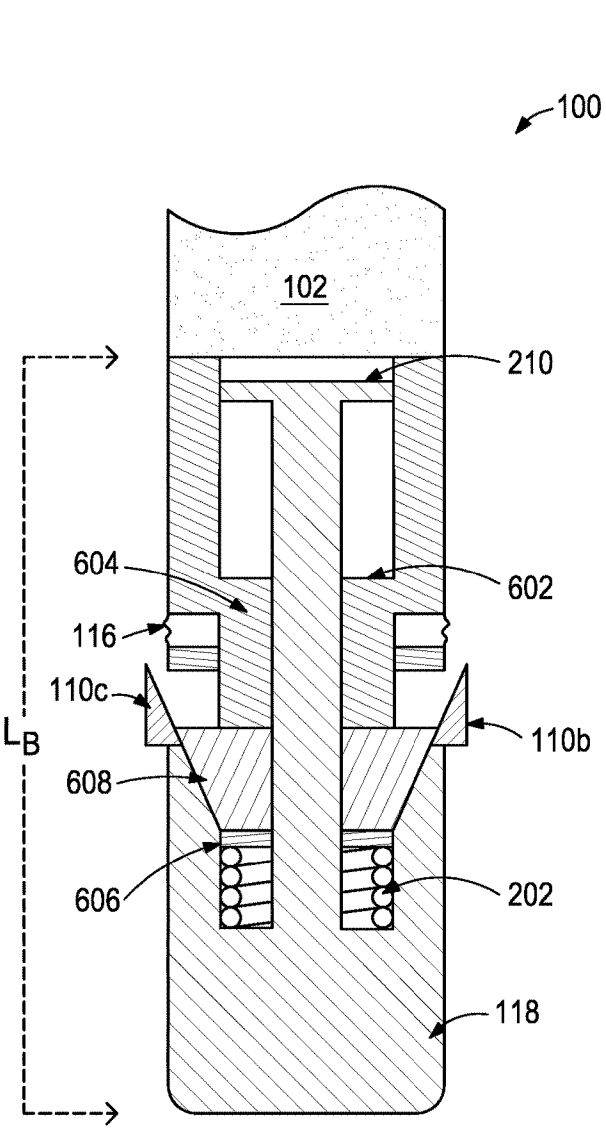
FIG. 6B illustrates a cross-sectional view of the fourth non-limiting example internal mechanism that can be embodied by the anti-spin device while in the compressed state in accordance with one or more embodiments described herein.
Figure 6A:
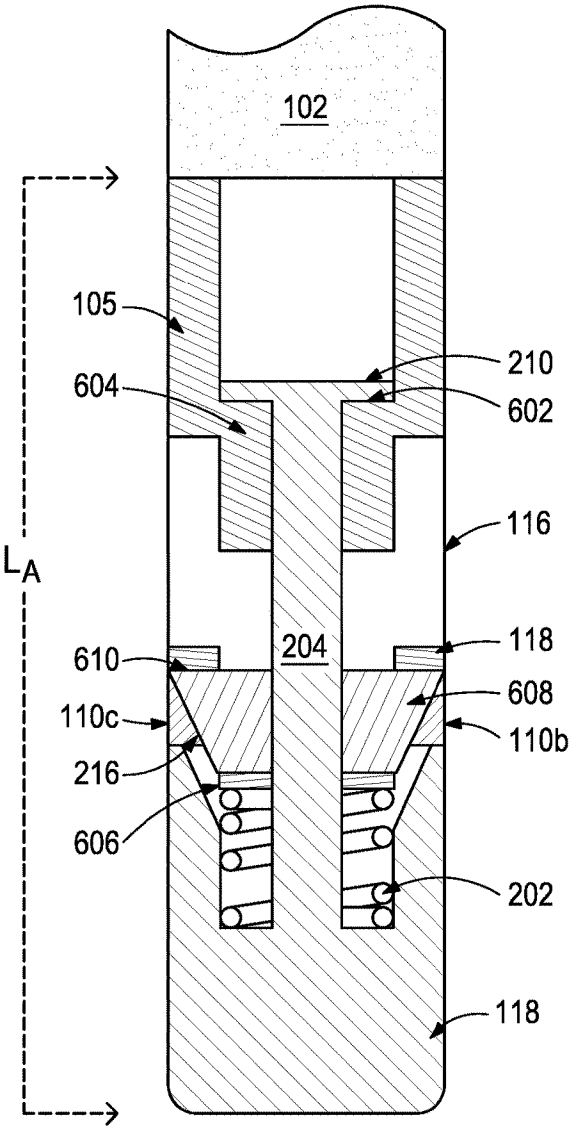
FIG. 6A illustrates a cross-sectional view of a fourth non-limiting example internal mechanism that can be embodied by the anti-spin device while in the non-compressed state in accordance with one or more embodiments described herein.

FIGS. 6A-6B illustrate cross-sectional views of the non-limiting example anti-spin device 100 shown in FIG. 5 in accordance with one or more embodiments described herein. FIG. 6A depicts the example anti-spin device 100 in the non-compressed state, and FIG. 6B depicts the example anti-spin device 100 in the compressed state. In the non-compressed state, the mandrel 204 can extend into the body 105 of the housing 104 and rest on a ledge 602. For example, the body 105 of the housing 104 can extend inward toward the longitudinal axis A-A' of the anti-spin device 100 to establish the ledge 602. Additionally, a portion of the body 105 of the housing 104 that is positioned directly below the ledge 602 can serve as an activator pusher section 604. As shown in FIG. 6A, the activator pusher section 604 can support the uphole end 210 of the mandrel 204, and thereby support the head 118 of the housing 104. In particular, the head 118 of the housing 104 can hang from the activator pusher section 604 while the anti-spin device 100 is in the non-compressed state.

In various embodiments, the spring 202 can be positioned under a plate 606 that supports one or more slip activators 608. As shown in FIGS. 6A-6B, the slip activators 608 can be positioned adjacent to the slips 110 within the housing 104 (e.g., within the head 118 of the housing 104). For instances, an outward sidewall 610 of the slip activators 608 can abut the interior slanted side surface 216 of the slips 110. Thereby, in one or more embodiments, the interior slanted side surface 216 of the slips 110 can be configured to engage the slip activators 608, rather than the mandrel 204.

Once the head 118 reaches a solid surface, the head 118 can be supported by the solid surface rather than the activator pusher section 604. Further, as a result of additional force applied to the body 105 of the housing 104, the anti-spin device 100 can translate into the compressed state. As shown in FIG. 6B, the uphole end 210 of the mandrel 204 can travel through the inner cavity 205 defined by the body 105 of the housing 104. Additionally, the activator pusher section 504 can travel towards the one or more slip activators 608. As the anti-spin device 100 is compressed, the activator pusher section 604 engages the slip activators 608 to push the slip activators 608 toward the head 118 of the housing 104. In turn, the slip activators 608 engage the interior slanted side surface 216 of the slips 110 to push the slips 110 away from the longitudinal axis A-A' of the anti-spin device 100. Thereby, the slips 110 are pushed outward into the surrounding environment in accordance with the various embodiments described herein.

For example, once a solid surface is reach by the anti-spin device 100, the head 118 of the housing 104 will rest on the solid surface and allow the activator pusher section 604 to move towards the slip activators 608 as pressure is applied to the well equipment 102 (e.g., during a milling operation). As the activator pusher section 604 presses the slip activators 608, the spring 202 is compressed and the slip activators 608 move toward the head 118 of the housing 104. In turn, the slip activators 608 push the slips 110 sideways, through the corresponding slots 106, and away from the exterior surface 108 of the housing 104. Thereby, the contact surface 112 of the slips 110 engages the surrounding sidewalls of the wellbore or casing to stop the well equipment 102 from spinning during the milling operation. Upon completion of the milling operation, the weight on the anti-spin device 100 can be lifted, the spring 202 can push the slip activators 608 back toward the body 105 of the housing 104, and the slips 110 can be retracted back into the housing 104.

Figure 7:
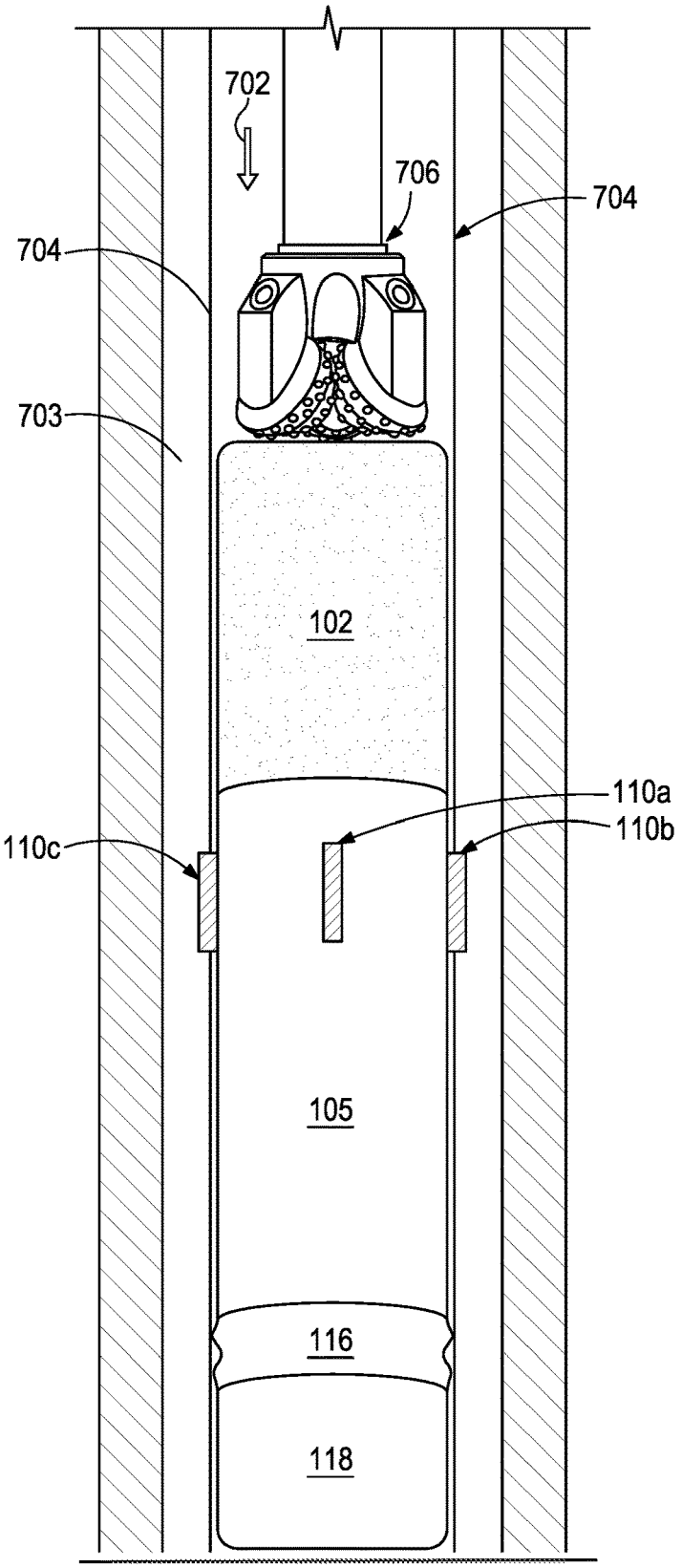
FIG. 7 illustrates a cross-sectional view of the non-limiting example anti-spin device within a wellbore during a milling operation in accordance with one or more embodiments described herein.

FIG. 7 illustrates a cross-sectional view of a non-limiting example of the anti-spin device 100 as positioned within an example wellbore 702 while in the compressed state in accordance with one or more embodiments described herein. In some embodiments, the wellbore 702 may be "open-hole" and otherwise not lined with any structure. In such embodiments, the anti-spin device 100 may be configured to actuate to engage the inner wall of the wellbore 702. In other embodiments, however, the wellbore 702 may be lined with a string of casing or liner 703 (collectively referred to herein as "casing 703"). In such embodiments, the anti-spin device 100 may be configured to actuate to engage the inner wall of the casing 703.

As shown in FIG. 7, the anti-spin device 100 can be compressed during a milling operation, thus transitioning the anti-spin device 100 from the non-compressed state to the compressed state. In the compressed state, the slips 110 are urged to extend radially outward and into the inner wall 704 of the wellbore 702 or the casing 703. Engaging the slips 110 against the inner wall 704 may help prevent the well equipment 102 from spinning while being milled by a drill bit or mill 706. For example, the well equipment 102 can be a bridge plug, and the anti-spin device 100 can either be coupled to the bridge plug or form an integral part thereof. Contact between the radially extended slips 110 and the inner wall 704 can inhibit rotation and/or spinning of the anti-spin device 100 within the wellbore 702, and thereby simultaneously inhibit rotation and/or spinning of the well equipment 102 during a milling operation.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, as used herein, the terms "coupled" or "coupled to" or "connected" or "connected to" or "attached"

or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A downhole tool, comprising:

an anti-spin device operatively coupled to a bridge plug and including:

an elongate housing coupled to a downhole end of the bridge plug and defining an internal cavity;

one or more slips radially aligned with a corresponding one or more slots defined in the elongate housing;

a mandrel movably arranged within the internal cavity and terminating with a head; and a slip activator arranged within the internal cavity and engageable with the one or more slips when translating within the internal cavity, wherein placing an axial load on the bridge plug causes the anti-spin device to transition from a non-compressed state, where the slip activator is disengaged from the one or more slips, to a compressed state, where the slip activator slidingly contacts and engages the one or more slips to thereby urge the one or more slips radially outward and through the corresponding one or more slots.

2. The downhole tool of claim 1, further comprising a spring to naturally bias the anti-spin device to the non-compressed state.

3. The downhole tool of claim 2, wherein the spring is operably coupled to the elongate housing and the mandrel, and wherein the spring is surrounded by a sleeve coupled to the housing.

4. The downhole tool of claim 1, wherein the slip activator comprises a distal end of the mandrel.

5. The downhole tool of claim 4, wherein the one or more slips are positioned within the corresponding one or more slots and comprise a slanted surface that extends into the internal cavity based on the anti-spin device being in the non-compressed state, and wherein the mandrel is positioned adjacent the slanted surface when the anti-spin device is in the compressed state.

6. The downhole tool of claim 5, wherein the one or more slips are coupled to the elongate housing via a plurality of protrusions that extend into a plurality of grooves in sidewalls of the corresponding one or more slots.

7. The downhole tool of claim 5, wherein the one or more slips are coupled to the elongate housing via a corresponding one or more hinges.

8. The downhole tool of claim 5, wherein the one or more slips are coupled to the elongate housing via one or more corresponding rotatable mounting brackets centrally positioned on a side of the one or more slips facing a sidewall of the corresponding one or more slots.

9. The downhole tool of claim 1, wherein the mandrel moves towards the slips when transitioning to the compressed state.

10. A method, comprising:

advancing a mill into a wellbore and toward a bridge plug arranged within the wellbore;

placing an axial load on the bridge plug with the mill and thereby actuating an anti-spin device operatively coupled to the bridge plug, the anti-spin device including:

an elongate housing coupled to a downhole end of the bridge plug and defining an internal cavity;

one or more slips radially aligned with a corresponding one or more slots defined in the elongate housing;

a mandrel movably arranged within the internal cavity and terminating with a head; and a slip activator movably arranged within the internal cavity and engageable with the one or more slips;

compressing the anti-spin device with the axial load between a non-compressed state, where the slip activator is disengaged from the one or more slips, and a compressed state, where the slip activator slidingly contacts and engages the one or more slips to thereby urge the one or more slips radially outward and through the corresponding one or more slots; and securing the anti-spin device within the wellbore and thereby preventing the bridge plug from rotating during milling of the bridge plug.

11. The method of claim 10, wherein the securing the anti-spin device within the wellbore comprises engaging and gripping an inner wall of the wellbore with the one or more slips.

12. The method of claim 10, wherein the wellbore is lined with casing and the bridge plug is arranged within the casing, and wherein the securing the anti-spin device within the wellbore comprises engaging and gripping an inner wall of the casing with the one or more slips.

13. The method of claim 10, wherein the slip activator is a distal end of the mandrel, and wherein compressing the anti-spin device comprises translating the mandrel within the internal cavity from a first position to a second position, and wherein the second position is adjacent the one or more slips.

14. The method of claim 13, wherein the one or more slips are coupled to the elongate housing via at least one of:

a hinge coupled to a sidewall of the corresponding one or more slots, a groove extending into the sidewall of the corresponding one or more slots, and a rotatable mounting bracket centrally positioned at a side of the one or more slips and extending to the sidewall of the corresponding one or more slots.

15. The method of claim 10, wherein the one or more slips have a slanted surface that extends into the internal cavity based on the anti-spin device being in a non-compressed state.

16. The method of claim 15, wherein the one or more slips further comprise a contact surface located opposite the slanted surface, and wherein the contact surface has an abrasive texture that engages an inner wall of a casing arranged within the wellbore during the securing the anti-spin device.

* * * * *